United States Patent [19]

Stahlecker

[11] Patent Number: 4,514,974

[45] Date of Patent: May 7, 1985

[54] OPEN END FRICTION SPINNING MACHINE

[75] Inventor: Fritz Stahlecker, Josef-Neidhart-Strasse 18, 7347 Bad Ueberkingen, Fed. Rep. of Germany

[73] Assignees: Hans Stahlecker; Fritz Stahlecker, of DEX

[21] Appl. No.: 573,633

[22] Filed: Jan. 25, 1984

[30] Foreign Application Priority Data

Feb. 18, 1983 [DE] Fed. Rep. of Germany ..... 3305621

[51] Int. Cl.[3] ..... D01H 1/135; D01H 1/20

[52] U.S. Cl. ..... 57/401; 57/104

[58] Field of Search ..... 57/400, 401, 92, 104, 57/105

[56] References Cited

U.S. PATENT DOCUMENTS

| | | | |
|---|---|---|---|
| 4,334,400 | 6/1982 | Fehrer | 57/401 X |
| 4,380,892 | 4/1983 | Parker et al. | 57/401 |
| 4,399,650 | 8/1983 | Parker et al. | 57/401 |

*Primary Examiner*—Donald Watkins
*Attorney, Agent, or Firm*—Barnes & Thornburg

[57] ABSTRACT

An open end friction spinning machine is disclosed which is made up of a plurality of adjacently arranged spinning units with respectively two spinning rollers forming a spinning wedge throat or slot and a fiber inlet and opening device. The two spinning rollers are advantageously disposed parallel to another and are arranged in a common bearing housing that forms a first construction unit. A second construction unit is formed by the respective inlet and opening device. These construction units are attached at a machine frame to be independently moveable with respect to one another. Between the two construction units thee is a pivotable intermediate piece, which in its driving position holds both of the construction units in their respective driving position and which automatically brings the construction units out of their driving position upon movement away of the intermediate piece through an adjusting arrangement.

32 Claims, 5 Drawing Figures

16
6
18
105
5
103
104
85
41,42
43
86
36
84
12
33,34
1
35
11
80
92
95
83
67
89
88
87
58
76
77
68
66
10
22
90
75
53
64
9
59
62
60
61
21
63
49
50
51
52
66
65
40
69
70
74
72
38,39
41,42
25
26
30
29
27
28
23
8
7
19
17
48
47
20
46
45
37
31
32
94
100

OPEN END FRICTION SPINNING MACHINE

BACKGROUND AND SUMMARY OF THE INVENTION

The invention relates to an open end friction spinning machine with a plurality of adjacently arranged spinning units at a machine frame which are connected to a common driving element extending in the longitudinal machine direction, each of which spinning units including respectively an inlet and opening device for fiber material to be processed and two rollers forming a yarn spinning wedge slot or throat, and which spinning units are respectively moveable from a driving position to a non-driving position with the connection to the driving element interrupted.

According to German published applications (D E OSen) No. 28 09 599 and No. 28 53 095, open end friction spinning machines are described wherein the wedge slot for the formation of the yarn is formed with two parallel axes rollers, disposed one inside of the other in such a manner that the wedge slot is formed out of a convex and a concave friction surface. The drive of the outer friction roller results from a tangential belt, from which belt a drive for the inner friction roller is derived by way of an auxiliary helping transmission. The inner friction roller forms, together with the associated inlet and opening device for the fiber material to be spun, a construction unit which can be moved to an out of drive position away from the longitudinally extending through driving element, whereby the inner roller is pulled out of the outer roller and the connection to the driving element is interrupted. This known open end friction spinning machine demands a high construction expenditure with which a large space is required. Perhaps more importantly, it is disadvantageous because the servicing position can only be achieved thereby with the relative movement with repect to one another of the two rollers building the wedge slot. Because it is very important to maintain the exact dimension of the wedge slot for the spinning results, there are very high demands on the tolerances so that thereby a very high manufacturing expenditure is required. Furthermore the wedge slot itself is not examinable because it is formed only through the closing and driving connection of the spinning unit.

The present invention is based upon the problem to so build an open end friction spinning machine of the above-mentioned kind that with minimum construction expenditures and the minimal space requirements, the individual elements of the spinning unit are arranged so the spinning units are easily assembled and maintained.

This problem is thereby solved according to one aspect of the invention by providing that the inlet and opening device of the spinning unit as well as the two adjacently arranged spinning rollers and common bearing housing therefore, are constructed as two construction units respectively movably held at the machine frame and that an intermediate piece is provided for holding one of the two construction units in the driving position in connection with and against the effect of adjustment apparatus, which intermediate piece is movable to a non-driving position.

To transfer or convert the spinning unit of the invention to the non-driving position, both of the two rollers are moved together as a unit so that their relative disposition with respect to one another is maintained and no changes in the spinning wedge slot results. By means of outward movement of the intermediate piece, which can advantageously be accomplished using a simple hand grip, both construction units are so moved that the driving is interrupted. With this arrangement, it is sufficient to have a relatively small movement for the two construction units so that a space-saving construction is achieved.

In advantageous arrangements of the invention it is provided that an intermediate housing for covering the wedge slot is provided as the intermediate piece, which intermediate piece, in the driving position, abuts against the respective associated bearing housing for the rollers and at an associated opening roller housing of the inlet and opening device, the intermediate housing at least partly including the fiber feed channel or tube from the opening roller to the spinning rollers. Thereby it is achieved that during a transfer to the non-driving position, the so-called servicing position, also the wedge slot is exposed for an inspection and in any event for maintenance. Furthermore, the fiber feed tube or channel is in a simple manner examinable.

In advantageous arrangements of the invention, it is further provided that the bearing housing for the spinning rollers for each respective spinning unit is carried for pivotal movement at the machine frame about an axle extending in the machine longitudinal direction. Thereby it is possible to achieve the non-driving position by means of a movement which is not hindered by the adjacent spinning units. A very space saving arrangement is further thereby achieved in that in further arrangments, the spinning rollers are arranged with vertically extending axles adjacent one another and that a common tangential belt is provided extending in the machine longitudinal direction for driving these rollers. The drive of both spinning rollers is thereby in any event simplified.

Embodiments of the inventin are proposed wherein the intermediate housing and the bearing housing for the spinning unit are provided with fittings for the alignment of the bearing housing with respect to the intermediate housing, which fittings come into gripping engagement with one another during the transfer of the intermediate housing to the driving position. Thereby it is assured that the alignment of the fiber feed tube relative to both spinning rollers, which is very important for the spinning technology, is assured without requiring large demands on the tolerances for the bearings themselves.

In further arrangements of the invention it is provided that the bearing housing of each spinning unit is provided with a holder which is held at the machine frame for movement about a pivot axle. Thereby it is especially advantageous if the holder is installed with downwardly open openings onto the pivot axle and with spring loaded securing means advantageously secured. With this arrangement, it is possible to easily remove one construction unit with its bearings carrying the spinning rollers and substitute another such construction unit.

According to a simple advantageous embodiment of the invention it is provided that a loaded spring biases against the bearing housing or the holder for the bearing housing, toward the non-driving position. This spring forms the adjustment device which effects an interruption of the drive of the rollers when the intermediate housing is displaced.

In further arrangments of the invention it is provided that the opening roller housing, which respectively accomodates the opening roller which is driven by a tangential belt extending in the machine longitudinal direction, is pivotally arranged for movement about a pivot axle extending transverse to the machine longitudinal direction to accomodate loosening from the tangential belt by pivotal movement. This results in a space-saving arrangement which only requires minimal space. Especially advantageous arrangements provide that the opening roller housing is pivotally carried by a feed roller carrying shaft of the inlet and opening device. Thereby the inelt and opening device is formed in a very compact construction unit which only requires a small construction space. It is furthermore advantageous to provide that the intermediate piece is guided at the opening roller housing with a gliding/sliding guide. This feature results in alignment of the intermediate piece with respect to the opening roller housing upon closing of the spinning aggregate or unit.

In further arrangements of the invention it is provided that a pivotable cover is arranged respectively at the associated spinning units at the servicing side opposite the machine frame. Thereby it is possible on the one hand to achieve an accident protection with respect to the spinning machine unit and simultaneously to camouflage the machine with an optically pleasing outer surface. Further a simple hand grip mounted at the cover provides an especially advantageous movement for a servicing procedure, whereby simultaneously the drive is also interrupted.

In further arrangements of the invention, there is a frame installed for each of the spinning units at the machine frame, at which respectively the pivot axles for the holder of the bearing housing and the pivot axle for the cover and the inlet and opening device are installed. Thereby it is possible, in spite of the assembly of the spinning rollers with the bearing housing as a construction unit and the inlet and opening device as a further construction unit, to provide that all these parts forming the spinning aggregate can be easily disassembled out of the open end friction machine without requiring a large installation expenditure and above all, also without disturbing the adjacent spinning units.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 3:
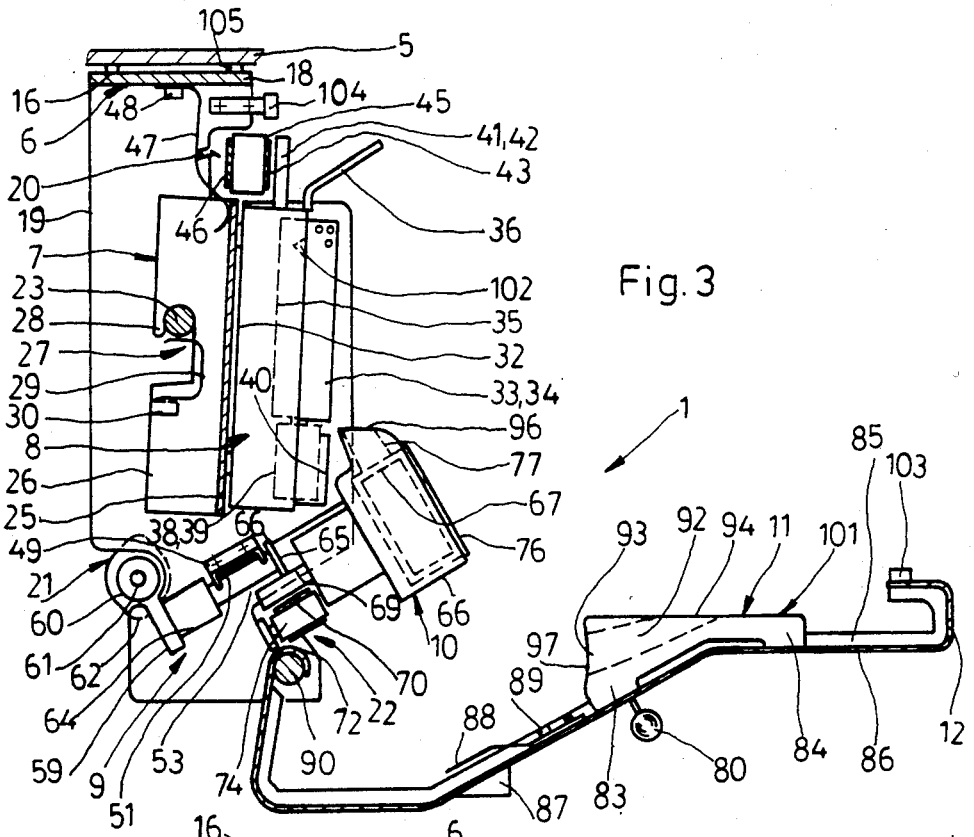
FIG. 3 is a sectional view through the spinning unit of FIG. 1 in a smaller scale, shown in the non-driving condition.
Figure 4:
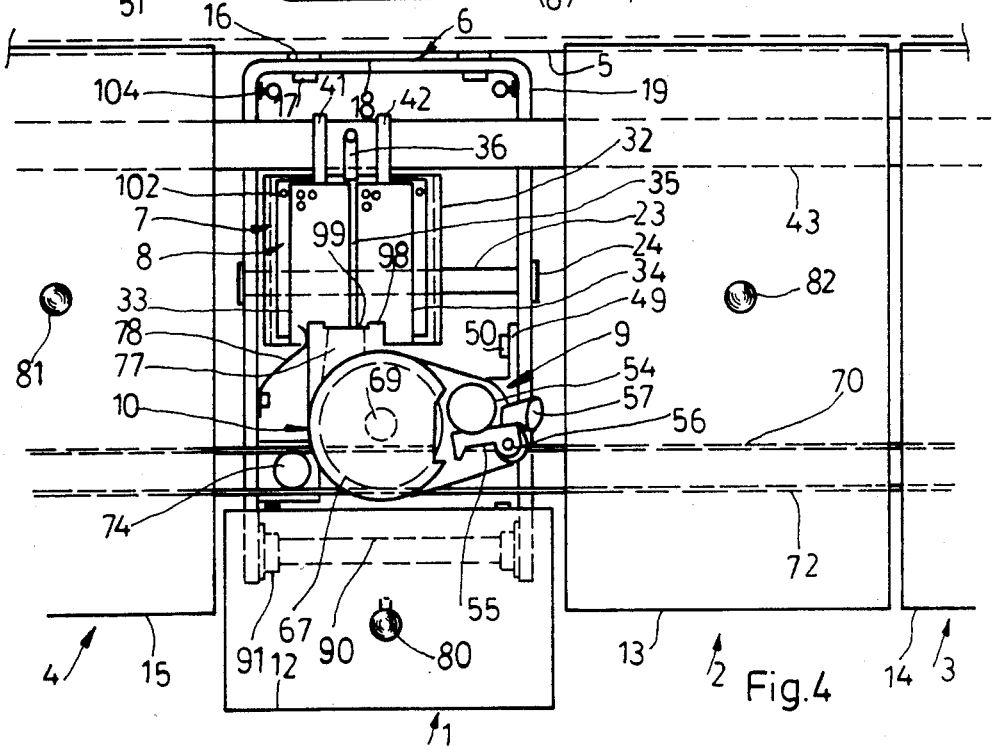
FIG. 4 is a view of the spinning unit of FIG. 3 from the servicing side.

The open end friction spinning machine, only a section of which is shown, includes a plurality of adjacently arranged spinning units 1, 2, 3, 4 . . . (FIG. 3), which advantageously are arranged at both sides of the open end friction spinning machine. These spinning units are all substantially identically constructed so that it is sufficient in the drawings and in the following description only to show and describe the spinning unit 1 and its attachment at a spinning machine frame. Each spinning unit 1, 2, 3, 4 . . . , possesses an inlet and opening device 9, 10, which draws in a fiber band 58 of essentially parallel fibers, opens the same into individual fibers and guides them by means of a feed duct 77, 92 to two rollers 33 and 34 which extend vertically and are arranged immediately adjacent one another to form a wedge slot 35 in which the yarn or thread formation results. The separated fibers are fed via the mouth 94 of the feed channel 77, 92 either immediately to the wedge slot 35 or onto the coating surface of the inward turning roller 34 and then to the wedge slot.

At least one of the two rollers 33, 34, especially the roller turning inward toward the wedge slot 35, is constructed as a so-called suction roller, which for this purpose includes a perforated coating surface and a suction insert arranged on its inside, which suction insert is connected in a not further illustrated manner to a vacuum or under-pressure source. The suction insert is then so formed that it borders a suction region which extends up into the wedge slot 35. The resultant yarn is drawn off in the direction of the wedge slot 35 via a yarn withdrawal tube 36, which extends as an elongation of wedge slot 35 in the region immediately adjacent the wedge slot 35 and then is curved toward the outside as shown.

A withdrawal device including a pair of draw off rollers is connected at the yarn withdrawal tube 36, followed by a winding arrangement with which the yarn can be wound on a spool. Since the yarn withdrawal and winding arrangement can be selected from existing designs, the same are not further illustrated and described in order not to obscure the present invention.

The inlet and opening device 9, 10 is formed as a self-sufficient construction unit for each spinning unit 1, 2, 3, 4 . . . . Each inlet and opening device 9, 10 includes an inlet roller 54 which is rotationally fixed at a shaft carried in a tube or support 53. At the end of the tube or support 53 opposite the inlet roller 54, the shaft is provided with a switch clutch or coupling 64 which connects the shaft with a worm wheel 59, which in turn engages a toothed wheel 60 of a through extending driving shaft 61 extending in the machine longitudinal direction. The switch coupling 64 is actuated in a not further illustrated manner via a not illustrated thread detector, which opens the switch clutch 64 so that the fiber feed is interrupted upon detection of a thread break. The inlet or feeding roller 54 is arranged adjacent a feed table 55 pivotably mounted about axle 56. The fiber band 58 is guided via an inlet drum 57 to the clamping position between the feed roller 54 and the feed table 55. Following the feed roller 54 and the feed table 55 there is an opening roller 67 which rotates substantially faster than feeding roller 54 and which is provided at its circumference with a fitting of teeth or needles. The feed roller 54 and the feed table 55 offer the fiber band in the form of a fiber beard to the opening roller 67, which fiber beard then is opened by the opening roller 67 into individual fibers.

The opening roller 67 is surrounded by a housing 66 which is pivotably supported with a protrusion 65 at the pipe support tube 53 surrounding the feed roller 54. The support tube 53 and the recess of the protrusion 65 are maintained somewhat larger in diameter than the feed roller 54 so that the opening roller housing 66 can be pulled off in the axial direction from the feed roller 54.

The opening roller housing 66 possesses a further protrusion in which a shaft 69 of the opening roller 67 is carried with a bearing housing 68. The shaft 69 extends beyond the bearing housing 68 at the side thereof opposite the opening roller 67 and is there driven by tangential belt 70 which extends in the machine longitudinal direction. A tension roller 74 is arranged in the region of each spinning unit for the tangential belt 70, at which the return run 72 of the tangential belt 70 is return guided. By pivoting the opening roller housing 66 about the support 53 serving as a pivot axes, the shaft 69 can be lifted from the tangential belt 70 to interrupt the drive of the opening roller 67, as is more clearly described below. In the opening roller housing 66 there is arranged a first part piece 77 of a fiber feed duct or channel, which duct begins somewhat tangential to the circumference of the opening roller 67.

The two rollers 33 and 34 for each spinning unit are carried in a respective common bearing housing 8 which exhibits shell formed receptacles for the bearings 38 and 39 of the shafts 41 and 42 of the rollers 33 and 34. In these shell shaped receptacles of the bearing housing 8, the bearings 38 and 39 are pressed by means of a common and also shell shaped receptacle formed cover plate 40. The shafts 41 and 42 protrude also upward beyond the rollers 33 and 34 and are in this region driven by tangential belt 43 which runs in the machine longitudinal direction. A tension or idler roller 45 is provided in the region of each spinning unit for the tangential belt 43, which roller 45 guides the return run 46 of the tangential belt 43.

The bearing housing 8 extends in the axial direction of the vertically arranged roller 33 and 34 over their entire length and encompasses or surrounds approximately half of their coating surface. In a not further illustrated manner there can be arranged a cover at the upper end of the bearing housing 8, through which the shafts 41 and 42 penetrate and which receives or accomodates the yarn withdrawal tube 36. This cover can also receive the suction insert and the corresponding suction connection which is guided into one or both of the rollers 33 and 34.

The bearing housing 8 is fastened with its rear wall 32 at a holder 7. The holder 7 is formed of an essentially U-shaped vertically extending profile member, which profile member exhibits a cross piece 25 extending parallel to the rear wall 32 of the bearing housing 8 and accomodates the fastening of the bearing housing 8 by means of screws 31. The plate or bar sections 26 of the U-shaped profile, extending transversely to the machine longitudinal direction, are provided with openings 27 which exhibit a half circular shaped guide bounded by vertical protrusion 28 by means of which the holder 7 is installed from above about one of the pivot axles 23 formed as a cylindrical bolt or pin. The holder 7 together with the bearing housing 8 is pivotabley movably mounted about the pivot axle 23, which pivot axle extends in the machine longitudinal direction. The openings 27 are open downwardly and toward the rear.

To secure the holder 7 and the bearing housing 8 at the pivot axle 23, brackets 30 are arranged at the holder 7 and U-shaped bent plate springs 29 are held at the brackets and press from underneath against the pivot axle 23.

The connection between the opening roller housing 66 and the roller 33 and 34 is formed by an intermediate housing 11 which contains the second part piece 92 of the fiber feed duct. Mouth 94 of the fiber feed duct part piece 92 opens into the region of the wedge slot 35 or the region of the coating surface of one of the roller 33 or 34. Intermediate housing 11 extends at least approximately over the axial height of the rollers 33 and 34 and abuts at least with a border or edge at a vertically extending edge of the bearing housing 8 when in the driving or spinning operational position. The intermediate housing 11 is preferably provided with half shell shaped receptacles which surround the coated surface of the rollers 33 and 34 not bounded by housing 8. However, housing 11 can also be provided as essentially so constructed that it includes only the fiber feed channel, this means that the part piece 92 and the mouth or opening 94 and a plate formed part or the like which is supported at the edge of the bearing housing 8.

The intermediate housing 11 is supported further with a guide surface 95 at the opening roller housing 66, whereby the guide surface 95 exhibits at least one rib 98 and a groove 99, so that a respective alignment between the intermediate housing 11 and the opening roller housing 66 results. Also between the bearing housing 8 and the intermediate housing 11 there is provided an alignment device 100 which consists of two pins 101 arranged at the intermediate housing 11 and advantageously mating bell-shaped receptacles 102 arranged at the bearing housing 8. The intermediate housing 11 holds the bearing housing 8, as well as also the opening roller housing 66, in the driving position illustrated in FIGS. 1 and 2.

In the event the intermediate housing 11 is moved out of the driving position, there results an automatic movement of the opening roller housing 66 and also the bearing housing 8. For this purpose springs 78 and 47 are provided which in a similar manner are loaded against the opening roller housing 66 (FIG. 2) and also the holder 7 (FIG. 1), so that after the displacement of the intermediate housing 11, they are pivoted so far about their respective pivot axes 53 and 23, that the shafts 69, respectively 41 and 42, are lifted from the corresponding tangential drive belts 47 and 43. It is sufficient to assure an interruption of the drive to provide a relatively small pivotal movement of a few angular degrees for these housing and shafts. In a not further illustrated manner, it is advantageous if the movement of the opening roller housing 66 and the bearing housing 88 with respect to the holder 7 is limited, which can be achieved, for example, through a special formation and/or attachment of the springs 47 and 78.

The inlet and opening device 9, 10 is arranged under the rollers 33 and 34 such that the axles of the feed roller 54 and the opening roller 67 extend essentially transverse to the machine longitudinal direction. In order to have the most nearly straight line aligned fiber feed channel 77, 92 from the circumference of the opening roller 67 to the rollers 33 and 34, the axles of the inlet roller 54 and the opening rollers 67 are inclined to the horizontal whereby the opening roller 67 and the inlet roller 54 are arranged so far to the servicing side in front of the region of the rollers 33 and 34 that there results a straight line extending fiber feed channel 77, 92.

The entire servicing side of the spinning units, 1, 2, 3, 4 . . . , is covered by means of respectively arranged covers 12, 13, 14, 15 . . . , which covers extend respectively over the region of the inlet and opening device 9, 10 and also the rollers 33 and 34 and the tangential belt 43. This cover 12 (and covers 13, 14, . . . , for other spinning units) is manufactured out of sheet metal or plastic and is configured to closely conform to the contour of the spinning unit 1. Cover 12 is pivotally mounted for movement about a pivot axle 90 disposed under the inlet and opening device 9, 10, which axle 90 extends in the machine longitudinal direction to accomodate other covers 13, 14 . . . The intermediate housing 11 is fastened to the cover 12 by way of protrusions 83, 84. The outer smooth cover 12 is especially provided at the edges with stiffening ribs 85 extending towards the inside. Because the intermediate housing 11 aligns itself upon closing of the cover 12 with the help of slide guides 95 at the opening roller housing 66 and with the help of the protrusions 101 at the bores 102 of the bearing housing 8, the cover 12 must not have too much rigidity as to accomodate an exact alignment of the technologically important spinning parts with respect to one another.

By pivoting of the cover 12 downwardly, the spinning unit 1 is exposed in large areas so that the inlet and opening device 9 and 10 and also the rollers 33 and 34 are easily accessible. Because the intermediate housing is mounted for pivotable movement with the pivoting of the cover 12, the wedge slot 35 between the rollers 33 and 34 is also exposed when cover 12 is opened. Further it is achieved that the opening roller housing 66, by means of the spring 78, and also the bearing housing 8, by means of the spring 47, are pressed into the out of driving position in which the shaft 69 is lifted from the tangential belt 70 and the shaft 41 and 42 are lifted from the tangential belt 43. Because the opening of cover 12 normally occurs during or because of a thread break and also frequently leads to a thread break, the switch clutch 64 is also operated so that also the feed roller 54 is stopped.

The driving position of the cover 12, and therewith the intermediate housing 11 as well as the bearing housing 8 and the opening roller housing 66, is achieved by means of a latching device, which in the illustrated preferred embodiment consists of magnets 103 arranged at the cover 12 and a fixed disposed opposite pole magnet 104, which advantageously is adjustably mounted in the pivot direction of the cover 12 at the machine frame by means of a holder 105.

In the region of the yarn withdrawal tube 36, the cover 12 is provided with an opening 86 which is sufficiently large to permit free pivotable movement of the cover 12. In the region of the inlet drum 57, a fiber band inlet 87 is arranged at the cover 12 through wich the fiber band 58 can be guided from the outside through the cover 12. Further, a plate spring 88 is attached at the inside of the cover 12 by means of screws, which spring 88 abuts with a closed cover 12 from the outside against cover 76 for the opening roller housing 66 receptacle for the inlet roller 54 and the inlet table 55 and holds the same in the driving position. This plate spring 88 furthermore maintains the entire opening roller housing 66, that can be dismantled from tube support 53 in the driving position. The cover 12 is further provided at the outside with a hand grip 80, which advantageously is arranged in the region of a protrusion 83 of the intermediate housing 11 so that a direct force transfer by closing is possible.

As can be seen from the foregoing, the bearing housing 8 and the rollers 33 and 34 form a construction unit which is held and moveable independently of the construction unit formed of the inlet and opening device 9, 10. For each spinning unit 1, 2, 3, and 4, there is however provided a common frame 6 which holds these two construction units and also the cover 12. This frame 6 is formed essentially out of a U-shaped sheet metal having downwardly extending shanks 19 and a horizontal protrusion 18 and is fastened from underneath with the help of fastening screws 17 and spacer pieces or washers 16 at a frame profile 5, especially a hollow profile extending in the machine longitudinal direction. The pivot axle 23 is fastened at the legs 19 with the help of flanges 24. Furthermore, the pivot axle 90 is fastened at the lowerpart of the legs 19 adjacent and vertically below the rollers 34 and 33. On one of the two legs 19 is furthermore provided a holder 51 with a flange 49 by means of screws 50, at which the support rube 53 is held by means of screws 52 so that the frame 6 also carries the inlet and opening device 9, 10. Further, one of the two legs 19 is provided with oppositely edged support bracket 75 at which bracket 75 the tension rollers 74 for the tangential belt 70 are arranged. The oppositely disposed leg 19 of the frame 6 is provided in a similar manner with an oppositely edged support bracket 37 (FIG. 1) at which the tension roller 45 is borne for the tangential belt 43. These rollers 45 are laterally offset to the bearing housing 8 and the holder 7 so that the dismantling through withdrawal of the holder 7 from the pivot axle 23 is not hindered or obstructed.

In the region of the driving elements extending through the machine longitudinal direction, the tangential belt 43, the tangential belt 70 and the drive shaft 61, the flanges or legs 19 are provided at the outer edges with open receptacles 20, 21, and 22, so that these through extending driving elements can be simply installed and assembled. The driving shaft 61 is held at a controlled spacing at respective ones of the spinning positions by means of a flange bearing 62 and screws 63 at the leg 19 of the frame 6.

The bearing housings 8 of the individual spinning units 1, 2, 3, 4 . . . can be dismantled by lifting off of the respective pivot axle 23 without influencing the adjacent spinning units. In the same manner, it is possible to dismantle the inlet and opening devices 9, 10 through loosening of the holders 51. It is further possible to dismantle the opening roller housing 66 by withdrawal from the support tube 53 alone, without interrupting or affecting the adjacent spinning aggregates or units. Furthermore, it is possible to dismantle the entire spinning unit by loosening of the frame 6 from the through extending profile 5, provided that the tangential belt 43 or 70 is previously removed.

Figure 1:
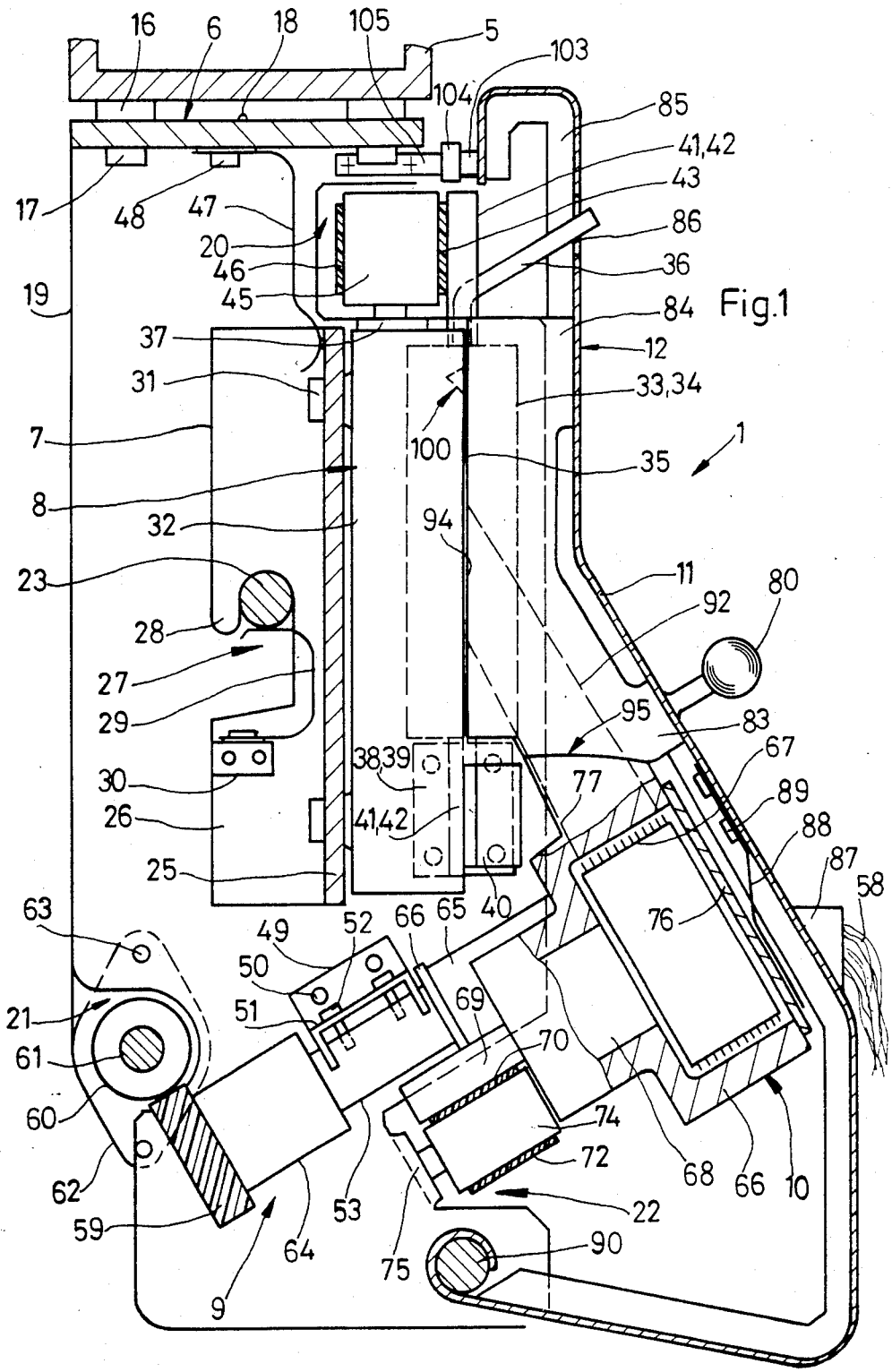
FIG. 1 is a vertical sectional view through an open end friction spinning machine in the region of a spinning unit and shown in a driving condition constructed in accordance with a preferred embodiment of the invention.
Figure 2:
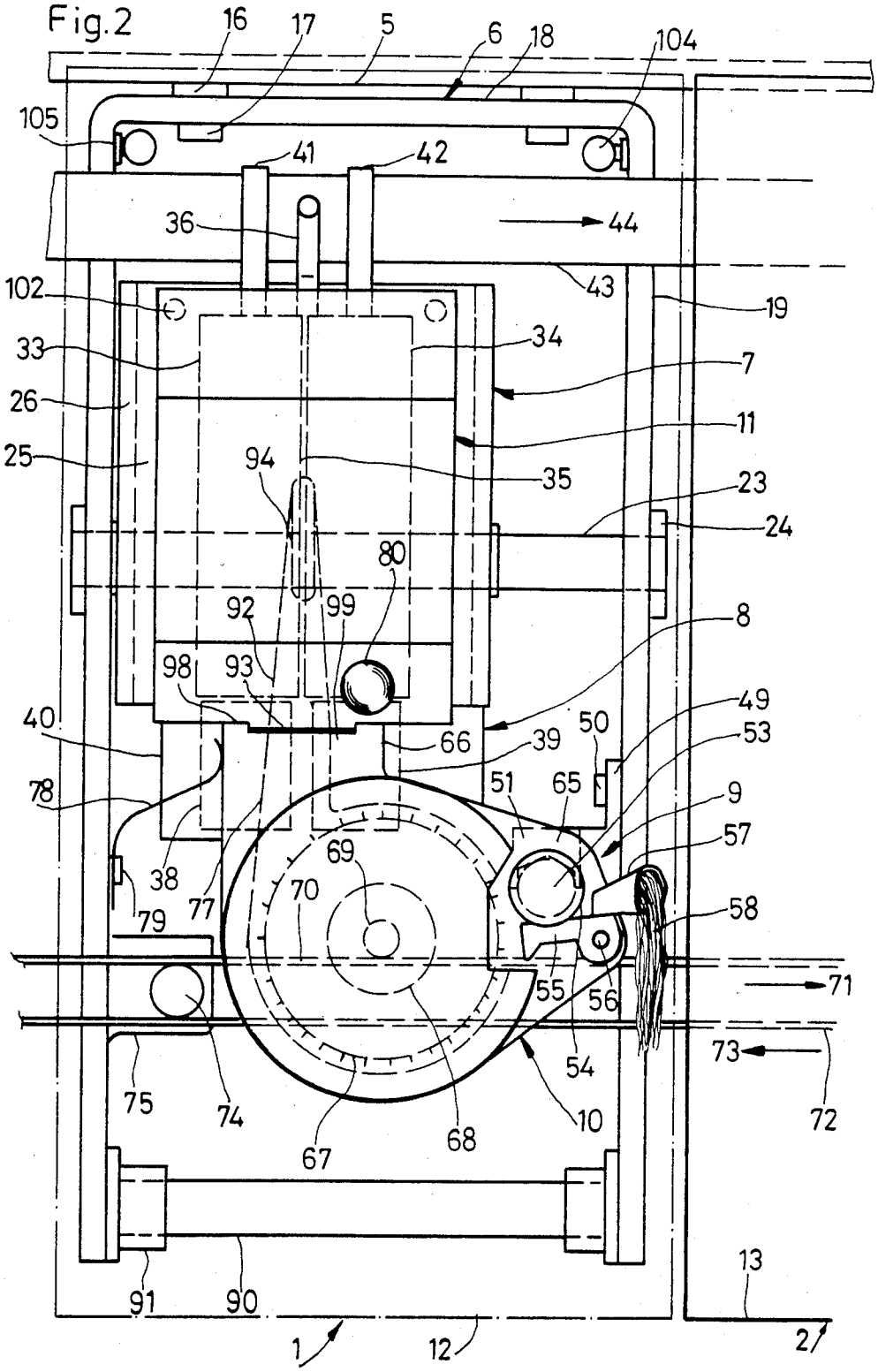
FIG. 2 is a view of the spinning unit of FIG. 1 from the servicing side, wherein the spinning unit covering cover is only shown in dashed lines.

As especially can be seen in FIGS. 1 and 2, also the springs 47 and 48 serving as adjusting devices are fastened between the frame 6 and the corresponding construction parts. The spring 47 is formed as a plate spring fastened with a screw 48 at the crosspiece 18 and the frame 6, which in the driving condition is in a pretensioned condition pressing against holder 7. The strength of the magnetic latch 104, 103 is so selected that it overrides the oppositely extended strength of the plate spring 47 to latch the unit in the operating position. The plate spring 78 is fastened by means of a screw 79 (FIG.

2) at one of the legs 19 of the frame 6 and abuts itself against the part piece 77 of the fiber feed channel containing regions of the opening roller housing 66. Under an appropriately selected pretensioning of plate spring 78, its spring path can in a simple manner be so arranged as to assure a sufficient movement of the opening roller housing 66 without requiring the provision of an abutment to limit this movement.

Figure 5:
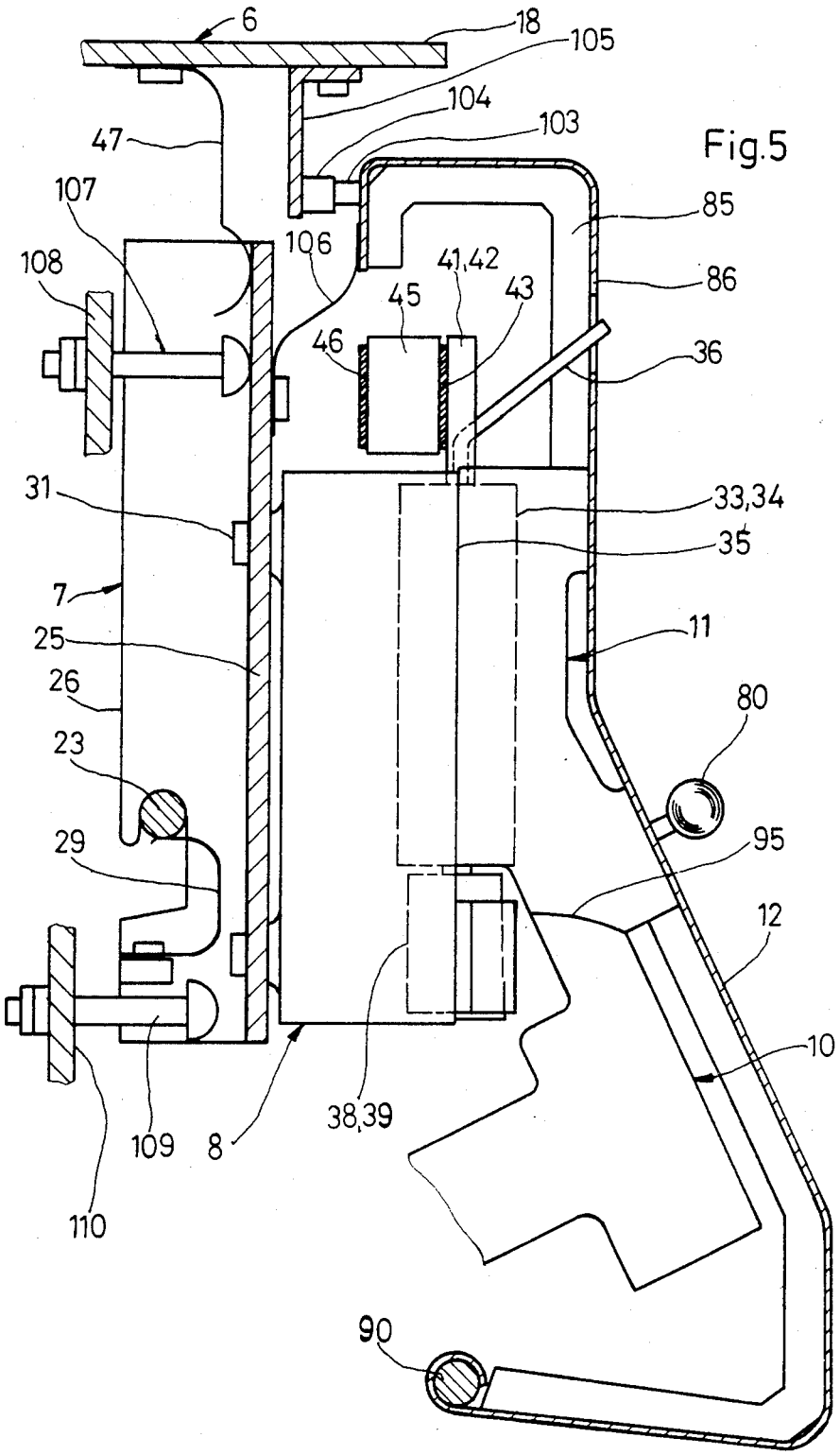
FIG. 5 is a part sectional view similar to FIG. 1 through a spinning unit of a further embodiment of the invention.

The embodiment of FIG. 5 corresponds essentially to the embodiment of FIGS. 1–4 so that the same reference characters are inserted for correspondingly functioning parts. Additionally in this embodiment, an abutment 107 is provided which is adjustably attached at the machine frame, especially at one of the cross pieces 108 of the frame 6 to adjust the operating position of the bearing housing 8 by abutting at holder 7. A similar adjustable abutment connection 109 is provided in order to limit the pivotable movement of the holder 7 and therewith the bearing housing 8. This abutment 109 is fastened likewise in a fixed position at the machine frame, especially at a cross piece 110 of the frame 6. Further in this embodiment according to FIG. 5, a plate spring 106 is provided which is arranged at the holder 7 and abuts against the cover 12 upon closing. This plate spring 106 effects that the holder 7 and therewith the bearing housing 8 is already pushed towards the driving position before the cover 12 and also the intermediate housing 11 have achieved the driving position. Because the plate spring 106 in any event operates against the latching device 103, 104, it must in any event be correspondingly dimensioned so that the latching device overcomes the spring force to hold the cover 12 and intermediate housing 11 in the closed, spinning unit operating position.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open end friction spinning machine having a plurality of spinning units disposed at a machine frame to be driven by common driving element means extending in the machine longitudinal direction, at least one of the spinning units comprising:

a pair of friction rollers disposed adjacent one another to form a wedge shaped yarn forming slot therebetween, a common bearing housing rotatably supporting the pair of friction rollers, said common bearing housing and friction rollers being assembled as a first construction unit which is mounted for movement into and out of driving connection with a common driving element means, fiber inlet and opening means for drawing in and opening fiber material to be fed to the yarn forming slot, said fiber inlet and opening means being assembled as a second construction unit which is mounted for movement into and out of driving element means, and a movable intermediate means engageable with both said first and second construction units to force said construction units toward one of their driving and non-driving positions against the effect of return force adjusting means.

2. Open end friction spinning machine according to claim 1, wherein said first and second construction units are mounted for movement separately from one another, and wherein said intermediate means is operable to force said construction units toward their driving positions.

3. Open end friction spinning machine according to claim 2, wherein said intermediate piece is constructed as an intermediate housing covering the wedge slot, said intermediate housing abutting at the common bearing housing and an opening roller housing an opening roller of the inlet and opening means when in its driving position, said intermediate housing at least partly including a fiber feed channel leading from the opening roller to the friction rollers.

4. Open end friction spinning machine according to claim 1, wherein the common bearing housing is pivotally mounted at an axle extending in the machine longitudinal direction.

5. Open end friction spinning machine according to claim 1, wherein the friction rollers are arranged with vertically extending axles adjacent one another, and that a tangential belt extending in the machine longitudinal direction is provided as the driving element means for driving of these friction rollers.

6. Open end friction spinning machine according to claim 2, wherein the intermediate housing and the common bearing housing are provided with alignment devices to align the intermediate housing to the bearing housing, which alignment devices operationally grip together with the movement of the intermediate housing to the driving position.

7. Open end friction spinning machine according to claim 6, wherein said alignment devices include at least one prong carried by one of the intermediate and common bearing housings which penetrates into an opening of the other of the intermediate and common bearing housing.

8. Open end friction spinning machine according to claim 4, wherein the common bearing housing is provided with a holder for holding the pivot axle at the machine frame.

9. Open end friction spinning machine according to claim 8, wherein the holder is installed from above with an open opening onto the pivot axle and is advantageously secured with spring securing means.

10. Open end friction spinning machine according to claim 8, wherein one of the common bearing housing and the holder is engageable with an advantageously adjustable abutment when in the machine driving position.

11. Open end friction spinning machine according to claim 10, wherein the pivot movement of the common bearing housing is abutted by means of an abutment at one of the common bearing housing and the holder.

12. Open end friction spinning machine according to claim 1, whereing the adjusting means includes a loaded spring engaging against the common bearing housing.

13. Open end friction spinning machine according to claim 1, wherein the common bearing housing is disposed adjacent and above the axial length of the friction rollers and covers their coated surfaces facing away from the machine frame.

14. Open end friction spinning machine according to claim 13, wherein the common bearing housing is provided with a cover of the front side of the friction roller in the yarn withdrawal direction, which cover carries a yarn withdrawal device.

15. Open end friction spinning machine according to claim 5, wherein the driven tangential belt extends above the common bearing housing for driving the friction rollers.

16. Open end friction spinning machine according to claim 3, wherein a tangential belt extending in the machine longitudinal direction is provided as the driving element means for the opening roller, and wherein the opening roller housing is arranged for pivotal movement about a pivot axle extending tranverse to the machine longitudinal direction.

17. Open end friction spinning machine according to claim 6, wherein the opening roller housing is pivotally carried at a shaft for an inlet roller of the inlet and opening device.

18. Open end friction spinning machine according to claim 17, wherein the shaft for the inlet roller is connected by means of a clutch coupling and a pair of toothed wheels to a driving shaft extending in the machine longitudinal direction and serving as a driving element means for the inlet roller.

19. Open end friction spinning machine according to claim 16, wherein said return force adjusting means includes a spring engaging at the opening roller housing in the direction returning the same toward driving contact with the tangential belt.

20. Open end friction spinning machine according to claim 3, wherein the intermediate piece is respectively guided at a guide surface of the opening roller housing.

21. Open end friction spinning machine according to claim 1, wherein the intermediate piece is arranged to be respectively pivotable about an axle extending in the machine longitudinal direction.

22. Open end friction spinning machine according to claim 21, wherein the intermediate piece is installed respectively at one of the respective spinning units with a pivotable cover at the side thereof oppositely of the machine frame.

23. Open end friction spinning machine according to claim 22, wherein the intermediate piece is constructed as an intermediate housing and carries a yarn withdrawal tube at a protrusion provided over the yarn withdrawal facing side of the friction rollers.

24. Open end friction spinning machine according to claim 23, wherein the cover is held at the machine frame in the driving position with respective latching mechanisms.

25. Open end friction spinning machine according to claim 1, wherein the inlet and opening device is essentially disposed below the common bearing housing.

26. Open end friction spinning machine according to claim 25, wherein the cover extends from underneath the inlet and opening device up to the region above a tangential belt for driving the friction rollers and is held at a pivot axle disposed under the inlet and opening device.

27. Open end friction spinning machine according to claim 26, wherein the cover and the intermediate housing are adjustably held in the direction of the pivot movement of the cover in the driving position by the latching mechanisms.

28. Open end friction spinning machine according to claim 27, wherein the latching mechanisms are magnetic latching devices between the machine frame and the cover.

29. Open end friction spinning machine according to claim 1, wherein for each spinning unit, a spinning unit frame is installed at the machine frame, at which respectively the pivot axles for a holder for the common bearing housing, a pivot axle for a cover, and at which the inlet and opening device are installed.

30. Open end friction spinning machine according to claim 29, wherein the spinning unit frame is formed as a downwardly open U-shaped bearing body, which is stiffened through the pivot axles extending between the legs thereof.

31. Open end friction spinning machine according to claim 29, wherein the spinning unit frame is hung or attached from beneath at a longitudinally extending profile of the machine frame.

32. Open end friction spinning machine according to claim 1, wherein a plurality of said spinning units are provided, disposed adjacent one another and being movable between driving and non-driving positions without interfering with the operation of adjacent spinning units.

* * * * *

UNITED STATES PATENT AND TRADEMARK OFFICE

CERTIFICATE OF CORRECTION

PATENT NO. : 4,514,974

DATED : May 7, 1985

INVENTOR(S) : Fritz Stahlecker

It is certified that error appears in the above-identified patent and that said Letters Patent is hereby corrected as shown below:

In [73] change "DEX" to --Federal Republic of Germany--.

Signed and Sealed this

*Twenty-first* Day of *January 1986*

[SEAL]

*Attest:*

DONALD J. QUIGG

*Attesting Officer*

*Commissioner of Patents and Trademarks*